US006371319B2

(12) United States Patent
Yeaton et al.

(10) Patent No.: US 6,371,319 B2
(45) **Date of Patent: *Apr. 16, 2002**

(54) CLOSURE SYSTEM FOR CONTAINERS

(75) Inventors: Stephen C. Yeaton, Lindenhurst; George M. Ramsay, Waukegan; Jacquie Trausch, Libertyville; Michael D. Laferriere, Gurnee, all of IL (US)

(73) Assignee: Abbott Laboratories, Abbott Park, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/935,160

(22) Filed: Sep. 22, 1997

(51) Int. Cl.[7] ..... B65D 53/00

(52) U.S. Cl. ..... 215/352; 215/354; 215/45; 215/44; 215/329; 220/378; 220/288

(58) Field of Search ..... 220/288, 378; 215/45, 44, 233, 321, 329, 341, 346, 353, 352, DIG. 1, 354

(56) References Cited

U.S. PATENT DOCUMENTS

| | | | | | |
|---|---|---|---|---|---|
| 633,297 | A | * | 9/1899 | Wanner | 215/346 X |
| 747,461 | A | * | 12/1903 | Millett | 215/353 X |
| 770,751 | A | * | 9/1904 | Hull | 215/346 |
| 1,151,875 | A | * | 8/1915 | Haslup | 215/346 |
| 1,625,963 | A | | 4/1927 | Snyder | |
| 1,712,977 | A | * | 5/1929 | Bohnhardt | 220/288 X |
| 1,786,802 | A | * | 12/1930 | Wamelink | 220/288 |
| 1,854,451 | A | | 4/1932 | Cooney | |
| 2,014,093 | A | * | 9/1935 | Terrill | 215/352 X |
| 2,107,179 | A | * | 2/1938 | Gibbs | 215/346 X |
| 2,221,527 | A | * | 11/1940 | Schick | 215/45 X |
| 2,308,126 | A | * | 1/1943 | Stover et al. | 215/352 X |
| 2,348,014 | A | * | 5/1944 | Mallard | 215/45 X |
| 2,364,678 | A | * | 12/1944 | White | 215/45 X |
| 2,365,737 | A | * | 12/1944 | White | 215/45 X |
| 2,492,144 | A | * | 12/1949 | Gora | 215/346 X |
| 2,633,264 | A | * | 3/1953 | Dinsmore et al. | 220/288 X |
| 2,731,165 | A | * | 1/1956 | Hohl | 215/45 X |
| 3,216,601 | A | * | 11/1965 | Wheaton | 215/346 |
| 3,286,868 | A | | 11/1966 | Mumford | |
| 3,305,120 | A | * | 2/1967 | Owen | 215/346 X |
| 3,435,976 | A | * | 4/1969 | Owens | 215/351 X |
| 3,589,545 | A | * | 6/1971 | Carpenter, Jr. | 215/349 X |
| 3,701,452 | A | * | 10/1972 | Tonn | 220/378 |
| 3,804,282 | A | * | 4/1974 | Komendowski | 215/40 X |
| 3,885,696 | A | * | 5/1975 | Eberhardt | 215/45 X |
| 3,891,118 | A | * | 6/1975 | Laurizio | 220/288 |
| 3,963,142 | A | * | 6/1976 | Hart | 215/352 X |
| 4,253,581 | A | * | 3/1981 | Aichinger et al. | 215/344 |
| 4,616,759 | A | * | 10/1986 | Mahler | 215/352 X |

(List continued on next page.)

FOREIGN PATENT DOCUMENTS

| | | | | |
|---|---|---|---|---|
| CA | 488839 | * | 12/1952 | 215/352 |
| DE | 2160798 | | 6/1973 | |
| EP | 0451257 | | 11/1995 | |
| FR | 845166 | * | 8/1939 | 215/44 |
| GB | 2022064 | | 12/1979 | |
| GB | 2235186 | | 2/1991 | |

*Primary Examiner*—Nathan J. Newhouse
*Assistant Examiner*—Robin A. Hylton
(74) *Attorney, Agent, or Firm*—Brian R. Woodworth

(57) ABSTRACT

A closure system for molded plastic containers having a threaded container neck, the closure system comprising a screw cap having internal threading constructed for threaded engagement with the threaded container neck, a gasket, means for retaining the gasket on the screw cap and an abutment surface integrally formed in and extending substantially radially from the container neck for sealably contacting the gasket, wherein the screw cap and the abutment surface are constructed so that downward axial rotation of the screw cap is effective to seal the gasket against the abutment surface.

7 Claims, 2 Drawing Sheets

U.S. PATENT DOCUMENTS 4,726,478 A * 2/1988 Zimmermann
4,811,857 A * 3/1989 Thompson ..... 215/45 X
4,936,483 A * 6/1990 Ballu ..... 220/378 X
4,957,211 A * 9/1990 Ekkert et al. ..... 215/349 X
5,009,323 A * 4/1991 Montgomery et al. ..... 215/341
5,035,798 A * 7/1991 Stenger ..... 215/346 X
5,297,688 A * 3/1994 Beck et al. ..... 215/344
5,337,912 A * 8/1994 Jochem ..... 215/321 X
5,374,121 A * 12/1994 Draenert ..... 215/321 X
5,453,149 A * 9/1995 Szczesniak
5,458,854 A * 10/1995 Burns ..... 215/321 X
5,487,481 A * 1/1996 Sander et al. ..... 215/344 X
5,498,333 A * 3/1996 Canther ..... 220/378 X

* cited by examiner

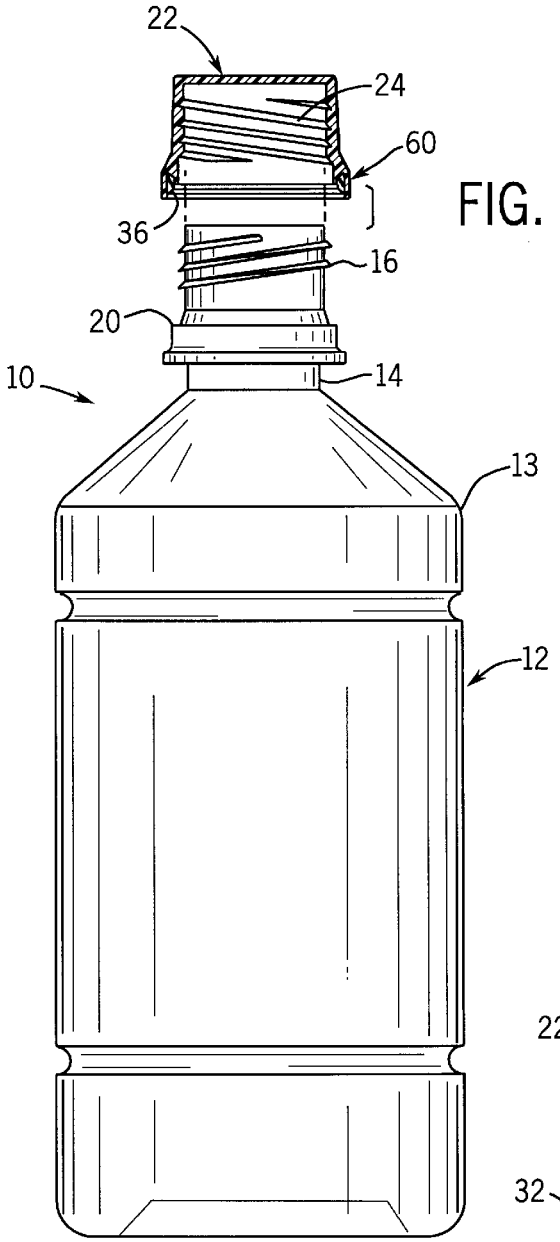
FIG. 1
FIG. 2
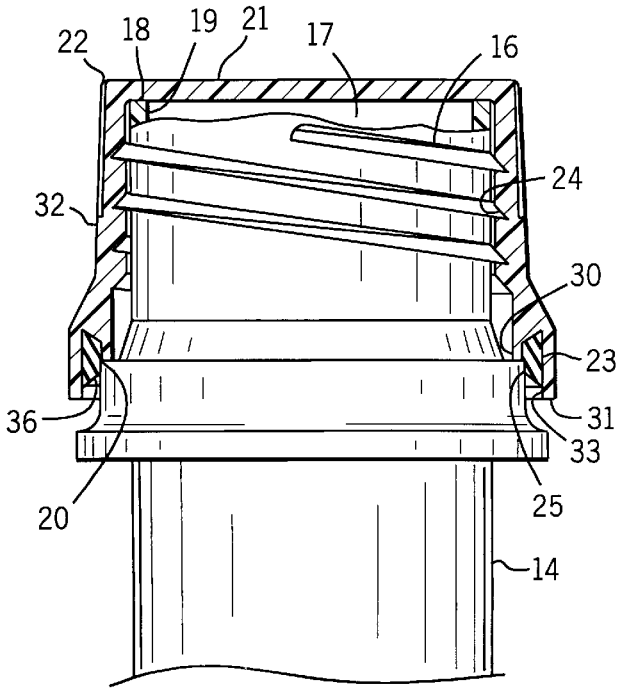

CLOSURE SYSTEM FOR CONTAINERS

FIELD OF THE INVENTION

The present invention relates, in general, to closure systems for molded plastic containers. In particular, the present invention relates to closure systems for molded plastic containers containing sterile fluids and having a cap associated therewith.

BACKGROUND OF THE INVENTION

Various food, medical and household products are presently packaged in molded plastic containers. Most of these containers include a dispensing port, and a closure system which creates a barrier for containing and/or protecting the contents of the container until the contents are to be used. Presently, many of these closure systems employ caps which are adapted to be easily removed. In particular, molded plastic containers are used to dispense sterile medical fluids for use in various medical procedures. For example, intravenous solution containers are used to administer parenteral solutions to a patient. Other medical containers are used to dispense irrigating fluids to a surgical site. Still other medical containers are used in enteral nutrition, inhalation, nebulizer, orthoscopic, mirror defogging, and x-ray preparation applications.

These medical containers have a common purpose of maintaining the sterility of their contents during manufacture, shipping, storage and dispensing. A critical portion of these containers is the closure system. The closure system must form and maintain a sterile barrier at a cap/container interface. This sterile barrier must remain intact from the time it is established until the time the container is intentionally opened for use. At the same time, these containers must be easily opened so that the contents of the container may be dispensed at the time of use.

The manufacture of medical containers typically includes a sterilization process such as autoclaving which subjects the container and contents to high temperatures typically in the range of approximately 118–121 degrees C. These temperatures can cause the pressure inside the container to be elevated above the pressure existing outside the container. Also, as the container is being cooled down from sterilizing temperatures, the pressure inside the container may drop below the pressure existing outside the container. The sterile barrier must be capable of withstanding these pressure differentials, to prevent air from any non-sterile environment which may exist outside the container from being drawn into the container during these processes, in order to maintain the sterile barrier.

As the contents of a container are being dispensed, the contents may come into contact with portions of the exterior of the container, therefore, it is often desirable that these areas also remain sterile. For this reason, the sterile barrier is typically located such that an exterior portion of the container adjacent to the dispensing port, including any threadings on the exterior of the container neck, is positioned between the sterile barrier and the contents of the container. In this way, the sterility of an external portion of the container can be maintained.

One means of providing a sterile barrier at a cap/container interface is to place a resilient gasket between the cap and the container and to exert compressive forces to sandwich together the cap, gasket and container whereby a sterile barrier may be established. Nevertheless, continuing problems remain in such closure systems in preventing the breach of the sterile barrier. Inherent factors can create difficulties in the establishment, maintenance and reliability of the sterile barrier. For example, typically the gasket is a separate component of the closure system, which requires that two critical sterile barriers be established and maintained; one at a cap/gasket interface and a second at a gasket/container interface. The reliability of such closure systems, which are dependent on the maintenance of two critical sterile barriers, is lessened as both sterile barriers are subject to failure. Also, such closure systems typically are not constructed to minimize movement and/or expansion of a gasket in directions other than the directions of applied compressive forces. This can affect the integrity and the reliability of such a closure system. Also, dimensional variations due to molding tolerances of cap, container and gasket components can make such closure systems unreliable and prone to failure.

Therefore, it is desirable to provide a closure system which forms a sterile barrier having high integrity and operational reliability. It is desirable that the sterile barrier be located so that an external area adjacent to the dispensing port remains sterile. It is also desirable to provide a closure system which allows the container to be easily opened so that the contents of the container may be dispensed at the time of use. Furthermore, since closure systems are often used only once and are disposed of after use, it is desirable that the cost of manufacturing the closure system is relatively low.

SUMMARY OF THE INVENTION

In accordance with the present invention there is provided a closure system for molded plastic containers which is capable of providing a sterile barrier or seal having high integrity and operational reliability. Also, the present invention provides a sterile barrier which is located so that the sterility of an external area adjacent to the dispensing port can be maintained in a sterile condition. Also, the present invention provides a closure system which allows the container to be easily opened at the time of use and which can be manufactured economically.

Specifically, the closure system comprises a screw cap having internal threading constructed for engagement with threading located on the exterior of the container neck. The cap has a sidewall. Inner and outer annular rims are integrally formed and extend downwardly from the sidewall of the cap. A resilient compressible gasket is positioned between the annular rims. The gasket is designed to engage against an abutment surface integrally formed in and extending radially from the container neck, to establish a sterile barrier when the cap is rotated downwardly onto the container neck.

In a preferred embodiment, the gasket and cap are integrally formed in a single injection molding operation to create a unitary component. Also, the abutment surface is subjected to an ultrasonic treatment, called swaging, which smooths the molding seams created during the molding process, particularly along the points-of-contact made by the gasket with the abutment surface when the gasket is fully seated against the abutment surface.

Thus, in accordance with the present invention, a closure system is provided which forms a sterile barrier having high integrity and operational reliability, is easily opened at the time of use, and has a relatively low manufacturing cost.

Numerous other advantages and features of the present invention will become readily apparent from the following detailed description of the invention and the disclosed embodiments thereof, from the claims and from the accompanying drawings in which the details of the invention are fully and completely disclosed as part of this specification.

BRIEF DESCRIPTION OF THE DRAWINGS

FIG. 1 is a side elevation view of the closure system of the present invention;

FIG. 2 is a side elevation view, partially broken away, showing in particular an upper portion of the closure system of the present invention;

DESCRIPTION OF PREFERRED EMBODIMENTS

Figure 3:
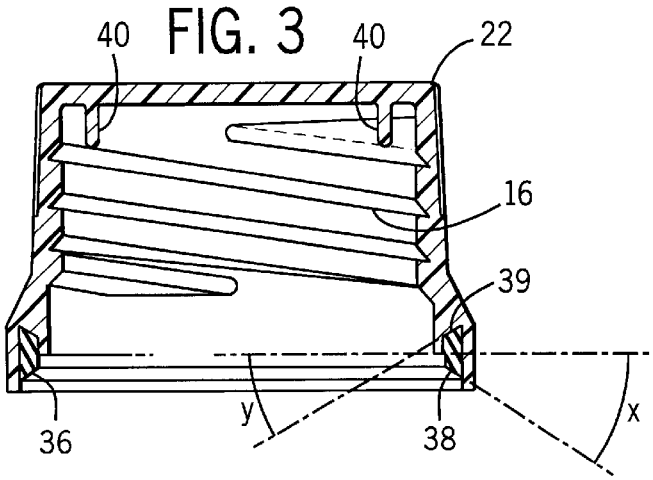
FIG. 3 is a cross sectional, side elevation view of a portion of the closure system of the present invention, showing in particular a plug seal.
Figure 4:
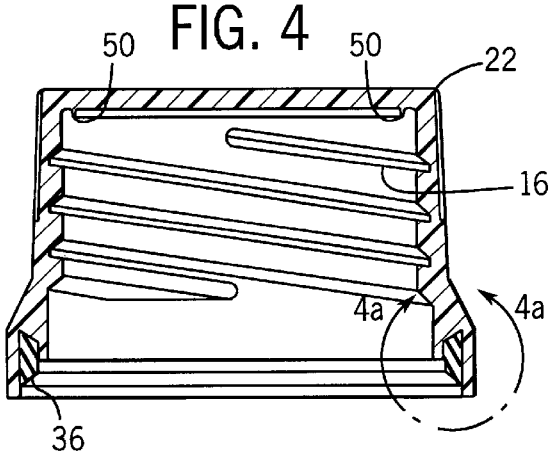
FIG. 4 is a cross sectional, side elevation view of a portion of the closure system of the present invention, showing in particular a knife seal.
Figure 4A:
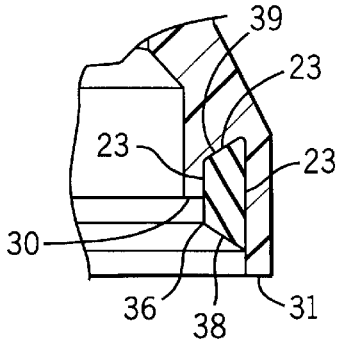
FIG. 4*a* is an enlarged view of a portion of the closure system of the present invention, showing in particular the gasket area.
Figure 5:
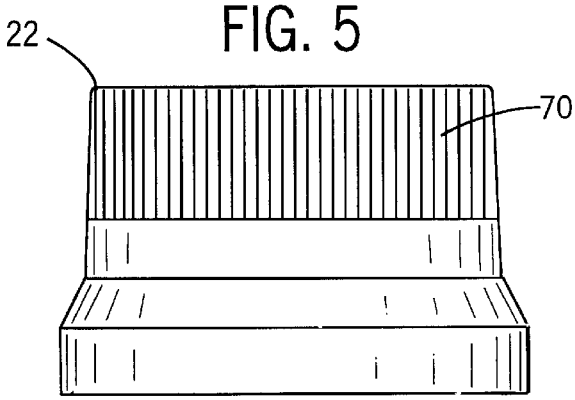
FIG. 5 is a side elevation view of a portion of the closure system of a present invention, showing in particular a knurled cap.

While this invention is susceptible of embodiment in many different forms, there is shown in the drawings and will be described herein in detail specific embodiments thereof with the understanding that the present disclosure is to be considered as an exemplification of the principles of the invention and is not intended to limit the invention to the specific embodiments illustrated.

The closure system incorporating the present invention is typically used with medical administration systems having certain conventional components the details of which, although not fully illustrated or described, will be apparent to those having skill in the art and having an understanding of the necessary functions of such components.

Referring to FIGS. 1 and 2, closure system 10 generally comprises molded plastic container 12 including container shoulder 13. Container 12 includes container neck 14 extending upwardly from container shoulder 13. Container 12 has dispensing port 17 defined by pour lip surface 18 formed at container neck 14. Helical external threading 16 is located on container neck 14. Abutment surface 20 is integrally formed on, and extends substantially radially from, container neck 14 and is located between external threading 16 and container shoulder 13. Closure system 10 further comprises screw cap 22 having helical internal threading 24 of proper size and construction for rotatable engagement with external threading 16 on container neck 14. Screw cap 22 includes top wall 21 and continuous cylindrical sidewall 32 extending downwardly from top wall 21. Inner annular rim 30 and outer annular rim 31 are integrally formed on, and extend downwardly from, sidewall 32 of screw cap 22. Inner annular rim 30 has a diameter which is less than the diameter of outer annular rim 31. Annular recess 33 is defined by inner and outer annular rims 30 and 31. Closure system 10 further comprises gasket 36 which is retained on screw cap 22. Gasket 36 may be retained on screw cap 22 by being positioned in annular recess 33 and held there by being pressure-fitted into place. Alternatively, gasket 36 may be retained on screw cap 22 other means, such as by being molded-in-place. Gasket 36 has a distal end which forms an angle of approximately 28°–38° relative to the top wall 21 of the screw cap 22.

Container 12 may be manufactured by conventional molding procedures using a thermoplastic material such as polypropylene, polyvinylchloride, polyethylene terphthalate, butadiene styrene, acrylics including acrylonitrile, polytetrafluoroethylene, polycarbonates and other thermoplastics. Screw cap 22 may be manufactured by injection molding a thermoplastic material such as polypropylene, polyvinylchloride, polyethylene terphthalate, butadiene styrene, acrylics including acrylonitrile, polytetrafluoroethylene, polycarbonates and other thermoplastics. Gasket 36 may be fabricated from resilient compressible material such as rubber, butadiene, polytetrafluoroethylene (such as TEFLON®), or injectable thermoplastic elastomeric co-polymers (such as KRATON® or C-FLEX®). The materials used for the container 12, screw cap 22 and gasket 36 should be selected from among materials compatible with the contents of the container, to prevent the materials from causing chemical changes to the contents of the container during storage and, also, to prevent the contents of the container from causing physical or chemical changes to the materials.

In a preferred embodiment as shown in FIG. 3, plug seal 40 extends downwardly from top wall 21 and coaxially with sidewall 32, with plug seal 40 having a diameter which is less than the diameter of sidewall 32. Plug seal 40 is configured to contact interior surface 19 of container neck 14. Plug seal 40 functions to create a barrier to reduce the likelihood of contact between the contents of container 12 and an exterior portion of container 12 adjacent to dispensing port 17, including external threading 16, prior to the time the contents of container 12 are used. This contact might otherwise occur, for example, as a result of splashing caused by the handling of container 12 during shipping or storage. Plug seal 40 is constructed so that contact between plug seal 40 and interior surface 19 does not prevent engagement of gasket 36 with abutment surface 20 upon engagement of internal threading 24 in screw cap 22 with external threading 16 on container neck 14. Also, abutment surface 20, screw cap 22 and gasket 36 are constructed so that contact between gasket 36 and abutment surface 20 does not prevent a barrier from being created by plug seal 40 coming into contact with interior surface 19, upon engagement of internal threading 24 in screw cap 22 with external threading 16 on container neck 14.

In an alternate preferred embodiment, knife seal 50 extends downwardly from top wall 21 and coaxially with sidewall 32, with knife seal 50 having a diameter which is less than the diameter of sidewall 32. Knife seal 50 is configured to contact pour lip surface 18. Knife seal 50 functions to create a barrier to reduce the likelihood of contact between the contents of container 12 and an exterior portion of container 12 adjacent to dispensing port 17, including external threading 16, prior to the time the contents of container 12 are used. Knife seal 50 is constructed so that contact between knife seal 50 and pour lip surface 18 does not prevent engagement of gasket 36 with abutment surface 20 upon engagement of internal threading 24 in screw cap 22 with external threading 16 on container neck 14. Also, abutment surface 20, screw cap 22 and gasket 36 are constructed so that contact between gasket 36 and abutment surface 20 does not prevent a barrier from being created by knife seal 50 coming into contact with pour lip surface 18, upon engagement of internal threading 24 in screw cap 22 with external threading 16 on container neck 14.

External threading 16 and internal threading 24 are constructed to establish sufficient contact between external and internal threadings 16 and 24 to establish a sterile barrier or seal at gasket/container interface 25, located between gasket 36 and abutment surface 20, and to maintain the sterile barrier from the time sterilization is established until the time the contents of container 12 are to be used.

In a preferred embodiment, container 12 is extrusion blow molded and is then subjected to a well-known treatment, namely ultrasonic treatment (sometimes referred to as swaging), which smooths the molding seams created during the molding process, particularly along the points-of-contact made between gasket 36 and abutment surface 20 when gasket 36 is fully seated against abutment surface 20.

In a preferred embodiment of the present invention, container 12 and screw cap 22 are polypropylene and gasket 36 is polytetrafluoroethylene. Also, screw cap 22 and gasket 36 are molded simultaneously using a well-known technique. One such technique is a molding process know as two-shot injection molding. The use of a two-shot injection molding process causes screw cap 22 and gasket 36 to bond together thereby producing a unitary component. In a preferred embodiment, screw cap 22, (including inner annular rim 30 and outer annular rim 31 integrally formed on sidewall 32 of screw cap 22) is produced by injection molding. Next, gasket material is injected as a "second shot" and gasket 36 is molded between inner and outer annular rims 30 and 31. In an alternate preferred embodiment, gasket 36 is produced by injection molding. Next, screw cap material is injected as a "second shot" and screw cap 22 is molded onto gasket 36.

Using two-shot injection molding to form gasket 36 and screw cap 22 can reduce the overall cost of the parts because the costs of handling, shipping, and stocking individually-molded gasket 36 and screw cap 22 parts may be avoided. Also, the cost of customized equipment which may otherwise be required to subsequently sort and assemble individually-molded gasket 36 and screw cap 22 parts may be avoided. Also, closure system 10 produced using the two-shot process can offer a reduced risk of a breach of sterility at a sterile barrier at cap/gasket interface 23 because the cap/gasket interface 23 is virtually eliminated when the materials used for screw cap 22 and for gasket 36 reflow and bond during the second shot of the process. Screw cap 22 and gasket 36 are essentially fused together. Also, the two-shot process can produce a closure system 10 in which dimensional variations which would otherwise affect the fit between gasket 36 and screw cap 22, and which would otherwise make the closure system less reliable and more prone to failure, are negated by forming gasket 36 and screw cap 22 into a unitary component.

In a preferred embodiment, container 12, screw cap 22, gasket 36 and the contents of container 12 are assembled and then the assembly is sterilized. Thus, the contents of container 12 are sterilized along with that portion of the assembly which is located on the sterile side of the sterile barrier, including the interior of container 12 and an exterior portion of container 12 (including external threading 16) which may come in contact with the contents of container 12 during use. In an alternate preferred embodiment, screw cap 22, gasket 36 and container 12 are sterilized and then closure system 10 is filled and assembled using aseptic procedures.

To attach screw cap 22 to container 12, screw cap 22 is threadably rotated downwardly on container neck 14, with engagement of internal threading 24 in screw cap 22 with external threading 16 on container neck 14, until further downward movement of screw cap 22 is retarded as compressed resilient gasket 36 comes into resistive contact with abutment surface 20. Inner and outer annular rims 30 and 31 retain gasket 36 and minimize movement and expansion of gasket 36 in directions other than the directions of applied compressive forces. Undesirable movements of gasket 36 are thereby eliminated and closure system 10, having high integrity and operational reliability, is provided.

Screw cap 22 may be removed from container 12 so that the contents of container 12 may be used. Subsequently, screw cap 22 may be reseated onto container neck 14.

Closure system 10 may include heat shrinkable outer member 60 which is placed external to container 12 to envelop the cap/container interface, thereby providing a tamper evident seal.

FIG. 3 illustrates a preferred embodiment of closure system 10 incorporating the present invention in which a distal end 38 of gasket 36 forms an angle "x" of between approximately 28 and 38 degrees relative to top wall 21 of screw cap 22, which, when brought into compressive contact with abutment surface 20, results in the establishment of compressive forces in both vertical and non-vertical directions. Also, a proximal end 39 of gasket 36 forms an angle "y" of approximately 35 degrees relative to top wall 21 of screw cap 22. These angles can increase the effectiveness of the sterile barrier provided by closure system 10.

In a preferred embodiment, the exterior surface of sidewall 32 contains knurls 70 so screw cap 22 can be removed more easily at the time of use.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A cap and container system comprising:

a cap having a top wall and a side wall extending from said top wall in a first direction, said side wall having a first portion and an end portion, an interior surface of said first portion defining a first thread thereon, an interior surface of said end portion having a gasket mounted thereon said interior surface of said end portion lying in a plane substantially parallel to the interior surface of said first portion, said gasket having a distal end positioned away from the top wall, the distal end forming an angle of approximately 28 to 38 degrees relative to the top wall;

a container having a first abutment surface, said first abutment surface constructed to sealingly engage said distal end of said gasket when said cap is mounted on said container, an exterior surface of said neck portion defining a second thread constructed to threadingly mate with said first thread.

2. A cap and container system in accordance with claim 1, wherein the gasket is bonded to the interior surface of said end portion of said side wall.

3. A cap and container system in accordance with claim 1, further comprising a sealing member extending from said top wall in said first direction, said sealing member being inwardly spaced from said edge portion of said top wall, said sealing member constructed to sealingly engage a surface;

a container having a second abutment surface, said second abutment surface constructed to sealingly engage said sealing memer when said cap is mounted on said container.

4. A cap and container system in accordance with claim 3, wherein said sealing member has an annular shape.

5. A cap and container system in accordance with claim 3, wherein said second abutment surface is defined on an interior surface of said container.

6. A cap and container system in accordance with claim 3, wherein said second abutment surface is defined on an exterior surface of said container.

7. A cap and container system comprising:

a cap having a top wall and a side wall extending from said top wall, said side wall having a first portion and an end portion, an interior surface of said first portion defining a first thread thereon, an interior surface of said end portion having a gasket bonded thereon said interior surface of said end portion lying in a plane substantially parallel to the interior surface of said first portion, said gasket having a distal end positioned away from the top wall, the distal end forming an angle of approximately 28 to 38 degrees relative to the top wall;

a container having an abutment surface, said abutment surface constructed to sealingly engage said distal end of said gasket when said cap is mounted on said container, an exterior surface of said neck portion defining a second thread constructed to threadingly mate with said first thread.

* * * * *